US011828441B2

(12) United States Patent
He

(10) Patent No.: US 11,828,441 B2
(45) Date of Patent: Nov. 28, 2023

(54) LED LAMP MANUFACTURED BY INJECTION MOLDING PROCESS

(71) Applicant: Chongyi Jingyi Lighting Product Co., Ltd, Jiangxi (CN)

(72) Inventor: Yaoquan He, Jiangxi (CN)

(73) Assignee: Chongyi Jingyi Lighting Product Co., Ltd, Ganzhou (CN)

( * ) Notice: Subject to any disclaimer, the term of this patent is extended or adjusted under 35 U.S.C. 154(b) by 0 days.

(21) Appl. No.: 17/876,206

(22) Filed: Jul. 28, 2022

(65) Prior Publication Data

US 2023/0036548 A1 Feb. 2, 2023

(51) Int. Cl.

| | |
|---|---|
| ***F21V 21/005*** | (2006.01) |
| ***F21V 15/01*** | (2006.01) |
| ***F21V 23/00*** | (2015.01) |
| ***F21Y 115/10*** | (2016.01) |

(52) U.S. Cl.
CPC ..... *F21V 21/005* (2013.01); *F21V 15/01* (2013.01); *F21V 23/002* (2013.01); *F21V 2200/00* (2015.01); *F21Y 2115/10* (2016.08)

(58) Field of Classification Search
CPC ..... F21V 21/005; F21V 15/01; F21V 23/002; F21V 2200/00; F21Y 2115/10; F21K 9/238; F21K 9/66; F21K 9/69; H01L 33/52
See application file for complete search history.

(56) References Cited

U.S. PATENT DOCUMENTS

| | | | | |
|---|---|---|---|---|
| 7,160,140 | B1 * | 1/2007 | Mrakovich | F21V 23/005 439/417 |
| 8,651,700 | B2 * | 2/2014 | Peng | F21S 4/10 362/249.06 |
| 2010/0155135 | A1 * | 6/2010 | Yamamoto | B60Q 3/51 174/536 |
| 2018/0175255 | A1 * | 6/2018 | Morikawa | H01L 33/486 |
| 2019/0017659 | A1 * | 1/2019 | Dendorfer | F21K 9/64 |

FOREIGN PATENT DOCUMENTS

| | | | | |
|---|---|---|---|---|
| EP | 2813758 | * | 12/2014 | F21V 23/00 |
| WO | WO 2012028450 | * | 3/2012 | F21V 33/00 |

* cited by examiner

*Primary Examiner* — Peggy A Neils
(74) *Attorney, Agent, or Firm* — Dragon Sun Law Firm, PC; Nathaniel Perkins

(57) ABSTRACT

Provided is an LED lamp manufactured by an injection molding process, including a strip-shaped LED lamp, wherein the strip-shaped LED lamp includes a first strip-shaped conducting wire and a least one LED luminous body disposed on the strip-shaped conducting wire, and each of the LED luminous bodies includes a first chip and a second chip connected to the first chip via a second conducting wire; the LED lamp manufactured by the injection molding process further includes an injection molding body, and the first strip-shaped conducting wire penetrates into the injection molding body; the injection molding body is further formed, in an injection molding manner, with a fixing portion for fixing the LED lamp manufactured by the injection molding process in a hole to be penetrated; the first chip in each of the LED luminous bodies is an LED chip.

4 Claims, 4 Drawing Sheets

LED LAMP MANUFACTURED BY INJECTION MOLDING PROCESS

CROSS REFERENCE TO RELATED APPLICATIONS

The present application claims benefits of the Chinese Patent Application No. 2021108692138, filed to the China National Intellectual Property Administration (CNIPA) on Jul. 28, 2021 and entitled "LED Lamp Manufactured by Injection Molding process" and the Chinese Patent Application No. 2021111032063, filed to the China National Intellectual Property Administration (CNIPA) on Sep. 18, 2021 and entitled "LED Lamp Manufactured by Injection Molding process", the entire contents of which are incorporated herein by reference.

TECHNICAL FIELD

The present invention relates to an LED lamp, in particular to an LED lamp manufactured by an injection molding process.

BACKGROUND

At present, an LED lamp manufactured by an injection molding process in the prior art still stays on the level of a complex structure and process.

For example, in an application CN111120919A filed on Jan. 22, 2020, an LED lamp was provided, but it was still clearly recorded in the paragraph [0038] of the description thereof that an LED light source component includes a PCB (note: printed circuit board) disposed in a packaging portion, a surface-mounted LED bead mounted on the PCB by an SMT and matched with a light guide post, and a conducting wire connected with the PCB and extending to the outside of the packaging portion; moreover, a complex glue filling process is recorded in detail in the paragraph [0039] of the description, wherein it is clearly recorded that a cavity 111 is disposed inside the packaging portion, the upper end of the cavity is provided with a mounting location for mounting the PCB, the top of the cavity above the mounting location is configured with a circle of convex ring 112 in contact with the surface of the mounted PCB, potting glue can be further stopped from entering a location near the surface-mounted LED bead on the basis of positioning the PCB, and thus, the potting glue is prevented from affecting the light emission of the bead; the surface-mounted LED bead is accommodated by the cavity portion in the convex ring, and light emitted by the surface-mounted LED bead is enabled to enter from the cavity portion to the light guide post relative to a wall of the packaging portion; and the potting glue is filled at the lower side of the PCB inside the packaging portion in a glue manner and is closed by a bottom cover 110 of the packaging portion, and thus, the fixing effect of the PCB is guaranteed, and the overall waterproofing grade is effectively improved.

For another example, in an application CN110657371A filed on Oct. 21, 2019, an LED lamp was provided, but it was still clearly recorded in the paragraph [0005] of the description thereof that a PCB is provided with several surface-mounted areas arranged in a matrix, and beads and resistors are disposed in the surface-mounted areas. Moreover, it was still clearly indicated in paragraphs [0020] and [0029] of the description thereof that it is a glue-filled LED lamp manufactured by an injection molding process.

Apparently, for the above-mentioned prior art, it can represent the latest situation of the industry of the LED lamp, it still stays on the level that the beads are connected with the PCB or resistors, which causes the fact that the structure is still complex, moreover, adopted is the potting glue which is longer in curing time, which further makes the process complex.

For further example, in an application CN210688152U filed on Dec. 6, 2019, an LED lamp was provided, but a complex specific structure was recorded in the paragraph [0006] of the description thereof that a housing is of a hollow cylindrical structure provided with an opening in one end and is made of a transparent material, the end, away from the opening, in the housing is provided with a mounting cavity for accommodating a lamp body, the lamp body is disposed in the mounting cavity, the lamp body is completely wrapped by the housing, the inner wall of the housing is provided with several fixing bumps used for preventing the lamp body from being removed and equidistantly disposed in the circumferential direction of the housing, several buckles equidistantly disposed in the circumferential direction of the housing are fixedly disposed on the outer wall of the housing, the housing is further provided with clamping rings used to be matched with the buckles, the clamping rings are located on the sides, facing the opening of the housing, of the buckles, and the fixing bumps and the buckles are made of a flexible material. Moreover, it was still clearly indicated in the paragraph [0020] of the description thereof that the housing is sealed by injecting transparent liquid glue.

That is to say, even if any content that the beads are connected with the PCB or the resistors is not disclosed in the above-mentioned prior art, as the latest situation of the industry of the LED lamp, a complex specific structure is still recorded, moreover, still adopted is the potting glue which is longer in curing time, which further makes the process complex.

In a word, the latest situation of the above-mentioned LED lamp indicates that the LED lamp in the field is complex in process, capable of easily causing a fault, longer in production time, lower in production efficiency, and higher in both of production time cost and expense cost.

SUMMARY

To this end, the present invention provides an LED lamp manufactured by an injection molding process, characterized in that:

- the LED lamp manufactured by the injection molding process includes a strip-shaped LED lamp, wherein the strip-shaped LED lamp includes a first strip-shaped conducting wire and a least one LED luminous body disposed on the strip-shaped conducting wire, and each of the LED luminous bodies includes a first chip and a second chip connected to the first chip via a second conducting wire;
- the LED lamp manufactured by the injection molding process further includes an injection molding body, and
- the first strip-shaped conducting wire penetrates into the injection molding body; the injection molding body is further formed, in an injection molding manner, with a fixing portion for fixing the LED lamp manufactured by the injection molding process in a hole to be penetrated;
- the first chip in each of the LED luminous bodies is an LED chip, and the second chip is used for controlling the power supply for the LED chip; and printed circuit boards and resistors are omitted in the LED luminous bodies.

More preferably, the second conducting wire includes any one of the following wires: a gold wire, a silver wire, and an alloy wire.

More preferably, buckles include a first buckle and a second buckle between which a buckle gap is disposed, and the LED lamp manufactured by the injection molding process passes through the buckle gap so as to be fixed on a plate through which the LED lamp manufactured by the injection molding process is to penetrate.

More preferably, buckles include a first buckle, a second buckle, a third buckle, and a fourth buckle, a first buckle gap is disposed between the first buckle and the second buckle, a second buckle gap is disposed between the third buckle and the fourth buckle, and the LED lamp manufactured by the injection molding process passes through the first buckle gap and/or the second buckle gap so as to be fixed on a plate through which the LED lamp manufactured by the injection molding process is to penetrate.

More preferably, when penetrating into the injection molding body, the first strip-shaped conducting wire penetrates into and out of the injection molding body via a hole in the injection molding body, and a penetrating-in portion of the first strip-shaped conducting wire and a penetrating-out portion of the first strip-shaped conducting wire approximately extend in the same direction; or the penetrating-in portion of the first strip-shaped conducting wire and the penetrating-out portion of the first strip-shaped conducting wire are approximately parallel.

More preferably, a pore is further reserved for the hole; and the pore enables the first strip-shaped conducting wire to fix the LED lamp manufactured by the injection molding process on the plate through which the LED lamp manufactured by the injection molding process is to penetrate.

More preferably, the second chip includes a constant-current chip.

More preferably, the first strip-shaped conducting wire includes two or at least three conducting wires which are insulated from one another.

More preferably, each of the LED luminous bodies further includes a third chip, and the third chip is used for processing a data signal of the LED chip.

More preferably, the LED lamp manufactured by the injection molding process includes a plurality of LED luminous bodies which are connected in parallel or in series.

In summary, according to the present invention, the structural complexity of the LED lamp manufactured by the injection molding process is remarkably lowered, that is, compared with the prior art, the present invention can achieve the control on the power supply for the LED chip by the second chip and the second conducting wire under the condition that the PCBs or the resistors are omitted, for example, the current, voltage or power of the LED chip is controlled. Moreover, a housing, allowing a strip-shaped conducting wire to penetrate, of the lamp can be formed rapidly, simply and conveniently by injection molding, and thus, the complexity is further lowered. Accordingly, the structure of the LED lamp manufactured by the injection molding process and a potential process therefor in the present invention are simpler in comparison with those in the prior art, which is beneficial to the reduction of the fault rate, the increment of the production efficiency and the reduction of the production cost.

BRIEF DESCRIPTION OF THE DRAWINGS

In order to describe the technical solutions in the embodiments of the present invention more clearly, a simple introduction on the accompanying drawings which are needed in the descriptions of the embodiments will be given below. It should be understood that the accompanying drawings in the descriptions below merely show some of the embodiments of the present invention, and therefore, they should not be regarded as limitations on the scope. Those of ordinary skill in the art may also obtain other relevant accompanying drawings according to these accompanying drawings without any creative effort.

Figure 1:
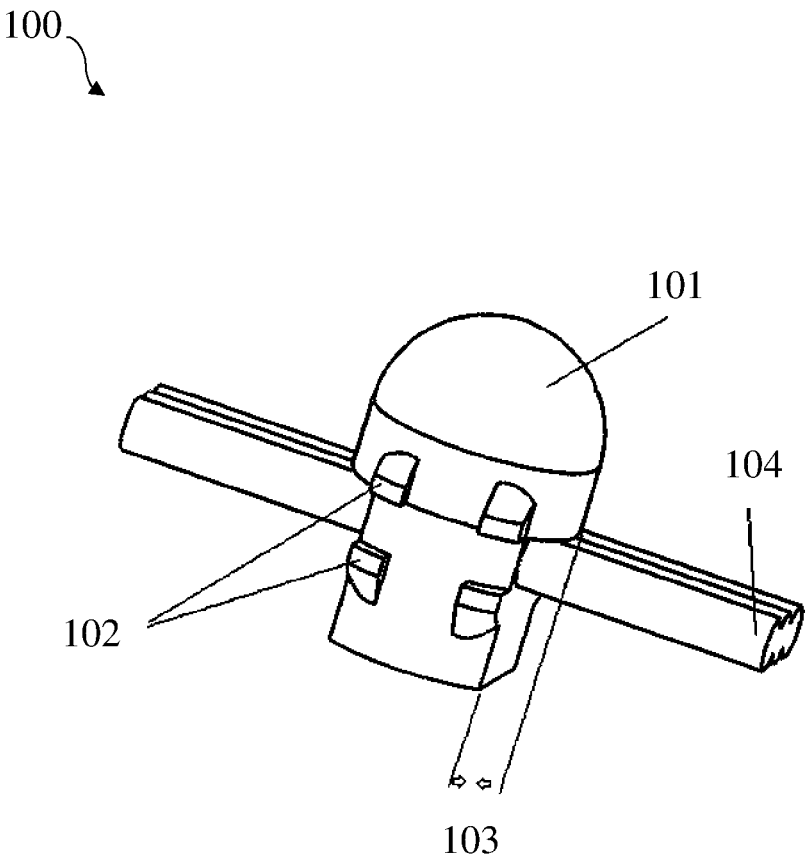
FIG. 1 is a schematic structural view of an LED lamp manufactured by an injection molding process in an embodiment of the present invention.

Reference signs in the accompanying drawings: 121—support frame; 122—first substrate; 123—second substrate; 124—first cup; 125—second cup; 126—light transmitting layer; 127—current-limiting IC; and 128—LED chip.

It needs to be noted that dimensional proportions between wires and all portions such as the LED luminous bodies and various ICs are not limited in the above-mentioned accompanying drawings, and most of the accompanying drawings show schematic structures, connection relationships, spatial position relationships and the like.

DETAILED DESCRIPTION

To make the objectives, technical solutions and advantages of the embodiments of the present invention clearer, a clear and complete description for the technical solutions in the embodiments of the present invention will be given below in combination with the accompanying drawings 1-4 in the embodiments of the present invention. Apparently, the embodiments described below are a part, but not all, of the embodiments of the present invention. Generally, components, described and shown in the accompanying drawings described herein, in the embodiments of the present invention may be arranged and designed with various different configurations.

Therefore, the following detailed descriptions for the embodiments of the present invention provided in the accompanying drawings are merely for embodiments selected in the present invention, but are not intended to limit the scope, claimed to be protected, of the present invention. All of the other embodiments, obtained by those of ordinary skill in the art based on the embodiments of the present invention without any inventive efforts, fall into the protection scope of the present invention.

It should be noted that similar numerals and letters represent similar items in the following accompanying drawings, and therefore, once a certain item is defined in one of the accompanying drawings, it does not need to be further defined and explained in the subsequent accompanying drawings.

In the descriptions of the present invention, it should be noted that directional or positional relationships indicated by terms such as "upper", "lower", "inner" and "outer" are directional or positional relationships based on the accompanying drawings or directional or positional relationships as usual when the product provided by the present invention is used, are merely intended to facilitate describing the present invention and simplifying the descriptions, rather than to indicate or imply that the appointed device or element has to be located in a specific direction or structured and operated in the specific direction so as not to be understood as restrictions on the present invention.

In addition, if terms such as "first" and "second" appear, they are merely used for the purpose of distinguishing descriptions, and may not be understood as indicating or implying the relative importance.

It needs to be noted that the features in the embodiments in the present invention may be combined with each other without conflicts.

In an embodiment, the present invention provides an LED lamp manufactured by an injection molding process, characterized in that:

the LED lamp manufactured by the injection molding process includes a strip-shaped LED lamp, wherein the strip-shaped LED lamp includes a first strip-shaped conducting wire and a least one LED luminous body disposed on the strip-shaped conducting wire, and each of the LED luminous bodies includes a first chip and a second chip connected to the first chip via a second conducting wire;

the LED lamp manufactured by the injection molding process further includes an injection molding body, and the first strip-shaped conducting wire penetrates into the injection molding body;

the injection molding body is further formed, in an injection molding manner, with a fixing portion for fixing the LED lamp manufactured by the injection molding process in a hole to be penetrated;

the first chip in each of the LED luminous bodies is an LED chip, and the second chip is used for controlling the power supply for the LED chip; and printed circuit boards and resistors are omitted in the LED luminous bodies.

In the prior art, a voltage and even a current are controlled by means of resistors, or power supply is controlled by means of printed circuit boards; however, in the present embodiment, the structural complexity of the LED lamp manufactured by the injection molding process is remarkably lowered, that is, in the present embodiment, the power supply for the LED chip can be controlled by the second chip and the second conducting wire under the condition that the PCBs or the resistors are omitted (note: the control on the current, voltage or power of the LED chip will be exampled hereinafter). It can be understood that the chips can be completely connected by the second conducting wire, and therefore, the structural complexity of the LED lamp manufactured by the injection molding process is lowered. Moreover, a housing of the lamp can be formed rapidly, simply and conveniently by injection molding, and thus, the complexity can be further lowered in the present embodiment.

Apparently, in the present embodiment, the complexity is mainly lowered in two aspects:

1. the printed circuit boards (PCBs) and the resistors are omitted in the structures of the LED luminous bodies;
2. by using an injection molding process, the structure of the housing is simpler; and therefore, the structure of the LED lamp manufactured by the injection molding process and a potential process therefor provided in the present embodiment are simpler in comparison with those in the prior art, which is beneficial to the reduction of the fault rate, the increment of the production efficiency and the reduction of the production cost.

In another embodiment, the injection molding body is further formed, in the injection molding manner, with the fixing portion for fixing the LED lamp manufactured by the injection molding process in the hole to be penetrated, wherein the fixing portion may be buckles formed by injection molding; or in addition to the buckles as the fixing portion, a fixing portion, enabling the LED lamp manufactured by the injection molding process to be fixed, in the other form may be formed by means of the elasticity of the injection molding body itself and the characteristic that the width of the injection molding body itself is slightly greater than the aperture of the hole to be penetrated; wherein the fixing portion in the other form may be the circumferential surface of the injection molding body itself or one or more elliptical bulges or in other forms which may be understood and are not restricted by specific shapes as long as the effect of fixing the LED lamp manufactured by the injection molding process may be achieved.

In another embodiment, the second conducting wire includes any one of the following wires: a gold wire, a silver wire, and an alloy wire.

It can be understood that the second conducting wire can be thinner than the first strip-shaped conducting wire. Of course, the second conducting wire may further include an FPC.

In another embodiment, the buckles include a first buckle and a second buckle between which a buckle gap is disposed, and the LED lamp manufactured by the injection molding process passes through the buckle gap so as to be fixed on a plate through which the LED lamp manufactured by the injection molding process is to penetrate.

It can be understood that the first buckle and the second buckle can be disposed on the same side or opposite sides. When the first buckle and the second buckle are disposed on the opposite sides, the buckle gap is formed when the first buckle and the second buckle are not located on the same horizontal position. No matter how to dispose the first buckle and the second buckle, the first buckle and the second buckle clamp the plate when the LED lamp manufactured by the injection molding process penetrates through the plate so as to fix the LED lamp manufactured by the injection molding process on the plate.

In another embodiment, the buckles include a first buckle, a second buckle, a third buckle, and a fourth buckle, a first buckle gap is disposed between the first buckle and the second buckle, a second buckle gap is disposed between the third buckle and the fourth buckle, and the LED lamp manufactured by the injection molding process passes through the first buckle gap and/or the second buckle gap so as to be fixed on a plate through which the LED lamp manufactured by the injection molding process is to penetrate.

For the above-mentioned two embodiments, it can be understood that all the buckles are best to be circumferentially and uniformly distributed on the injection molding body and form the corresponding buckle gaps. By only distributing the buckles on one side, fixation may also be achieved, only except that the performance of shake or vibration resistance is slightly poorer than that of the circumferential and uniform distribution; and if obvious shake or vibration occurs a little in some application scenarios itself, the manner of distributing the buckles on one side not only reduces the cost, but also can achieve a fixing effect.

With reference to FIG. 1 which schematically shows four buckles, it can be understood that the buckles can also be molded once by using an injection molding process in the process of forming the injection molding body.

It needs to be noted that the four buckles of the injection molding body can also be designed on two opposite sides, with one side being provided with the first buckle and the second buckle, and the other side being provided with the third buckle and the fourth buckle, thereby providing a better fixing effect. The buckle located on a position close to the upper portion in FIG. 1 can be known as an upper buckle, and the buckle located on a position close to the lower portion in a longitudinal direction can be known as a lower buckle. When the LED lamp manufactured by the injection molding process penetrates through a perforated plate, the LED lamp manufactured by the injection molding process is mounted on the plate in a buckle fixation manner.

Further, when the first buckle, the second buckle, the third buckle, and the fourth buckle are disposed on one side of the injection molding body (note: the other side is also optionally provided with four corresponding buckles, at the moment, the buckles are not shown in the figure), the first buckle and the third buckle may be located on a first height position of the injection molding body, the second buckle and the fourth buckle may be located on a second height position of the injection molding body, and the first buckle gap may be equal to the second buckle gap. However, furthermore, the first buckle gap may be not equal to the second buckle gap, for example, the first buckle and the second buckle may be spaced by the first buckle gap in the longitudinal direction, the third buckle and the fourth buckle may be spaced by the second buckle gap unequal to the first buckle gap in the longitudinal direction, and thus, the LED lamp manufactured by the injection molding process adapts to plates with at least two thicknesses. It can be understood that the thickness of the plate with the first thickness may be equal to the first buckle gap; and the thickness of the plate with the second thickness may be equal to the second buckle gap.

In another embodiment, when penetrating into the injection molding body, the first strip-shaped conducting wire penetrates into and out of the injection molding body via a hole in the injection molding body, and when the hole enables the first strip-shaped conducting wire to pass through, a pore is further reserved for the hole; and the pore enables the first strip-shaped conducting wire to fix the LED lamp manufactured by the injection molding process on the plate through which the LED lamp manufactured by the injection molding process is to penetrate.

For the embodiment, another solution for adapting to a plate with a different thickness is given in comparison with a different design for the buckles in the foregoing embodiment. According to this embodiment, the LED lamp manufactured by the injection molding process has the following possibility: if the distance among the buckles on different horizontal positions in the horizontal direction is greater than the thickness of a perforated plate, the strip-shaped conducting wire may be bent once or for many times by means of the pore, and the LED lamp manufactured by the injection molding process is fixed on the plate by the buckle gap and the bent conducting wire. It can be understood that the more flexible and thinner the strip-shaped conducting wire is, the easier the achievement of such an effect is.

In another embodiment, the first strip-shaped conducting wire includes two conducting wires which are insulated from each other.

In this case, the strip-shaped conducting wire only serves as a neutral/fire wire during AC power supply or a positive/negative wire during DC power supply.

In another embodiment, the second chip includes a constant-current chip.

It can be understood that, for the drive of the LED chip, constant-current driving has been a main driving manner at present. Therefore, for the present invention, the constant-current chip is preferred. Moreover, when a constant-current chip having a microcurrent is selected, the present invention is further beneficial to the achievement of high-voltage, micro-current and low-power power supply for the LED chip, which is specially significant and can ensure the LED lamp manufactured by the injection molding process is connected in parallel with more LED luminous bodies. The reason is that: when parallel cascade is selected as anterior and posterior cascade, all the LED luminous bodies may have the same voltage, and the current and power of each of the LED luminous bodies are controlled by the constant-current chip, so that it has more advantages than a serial high-voltage solution by which the current can be only precisely controlled in the prior art. In other words, the present invention can achieve a better solution for an LED lamp which is high in voltage, low in power, precisely controlled and manufactured by an injection molding process. Moreover, it is beneficial to the achievement of longer LED products connected in parallel, particularly, due to the microcurrent, the power of each path is relatively low under the condition that the current is limited at an extreme microcurrent as long as an LED can still meet visual brightness, the longer LED products connected in parallel can be achieved on the premise that the voltages of all branches connected in parallel are equal at constant total power.

In addition, when second LED luminous bodies connected in parallel are included, it is specially significant, which is due to the fact: when a plurality of LED luminous bodies are tandem connected in parallel, any one of the LED luminous bodies may be freely cut to meet demands on lengths in different scenarios. Even if a certain LED luminous body has a fault, the faulted LED luminous body can also be freely cut, then, front and rear electrode conducting wires can be directly connected, and thus, maintenance is convenient.

In another embodiment, the first strip-shaped conducting wire includes at least three conducting wires which are insulated from one another.

It needs to be noted that two of the conducting wires are used for power supply, and the third conducting wire may be used for transmitting a data signal.

In another embodiment, each of the LED luminous bodies further includes a third chip, and the third chip is used for processing a data signal of the LED chip.

It can be understood that the third chip may be independent from the second chip, and it is also possible that with the continuous development of technologies, the situation that the second chip and the third chip are integrated into one chip occurs.

In another embodiment, the LED lamp manufactured by the injection molding process includes a plurality of LED luminous bodies which are connected in parallel or in series.

In other words, a series connection solution may also be adopted in addition to typical parallel connection and high voltage solutions. During parallel connection, a plurality of LED chips may be connected in series in each of the LED luminous bodies, which is for the purpose of mainly meeting the demand of precisely controlling the currents of the LED luminous bodies while dividing voltages. Of course, the series connection of the LED luminous bodies also has the advantages of series connection itself, for example, the demand on the current is lowered, which is beneficial to the increment of the number of LED lamps.

In fact, the solution that the plurality of LED luminous bodies are connected in parallel is preferred in the present invention, each of the LED luminous bodies may be freely cut under the condition of parallel connection, and after being cut, each of the LED luminous bodies may meet the demand of a power supply voltage under the condition that a power source is connected, or else, each path of LED luminous bodies connected in parallel is directly burnt due to incapability of meeting the demand on the power supply voltage at the beginning even if the length is longer and more LED luminous bodies are connected in parallel. For example, in the scenario that a 110V-230V AC power supply is adopted, each of the LED luminous bodies internally includes dozens of LED chips connected in series or connected in series and parallel so as to bear a 110V or 230V AC voltage. Even if the LED lamp manufactured by the injection molding process in the present invention includes the three LED luminous bodies, when any one of the LED luminous bodies is cut and is connected to 110V or 230V AC power on the premise that the electrode conducting wires at two sides of the LED luminous body are stored, the LED luminous body may form a loop to emit light as long as the LED luminous body itself has no faults. As a contrast, it is apparent that such an advantage may not be achieved by the LED luminous bodies connected in series, the plurality of LED luminous bodies formed by series connection may work at the 110V or 230V voltage only when they are used as a whole, and if one of the LED luminous bodies is directly cut and is connected to the 110V or 230V voltage, it is greatly probable that the LED luminous body is burnt. It can be understood that the voltage in the present invention is not limited to voltages such as 100V and 230V, may conform to other power supply voltage standards or may be within a wider voltage range.

Hence, for the LED lamp manufactured by the injection molding process, each of the LED luminous bodies may be freely cut under the condition of parallel connection, and after being cut, each of the LED luminous bodies may meet the demand on the power supply voltage under the condition that the power source is connected. In addition, the faulted LED luminous body may be freely cut and connected with original front and rear sections under the condition that the LED luminous body has a fault, so that the LED luminous body may further work at the same power supply voltage under the condition that the length loss is not great, and the visual effect for illumination, namely the consistency of brightness, can be maintained.

In another embodiment, the LED luminous bodies are surface-mounted, which is more beneficial to the increment of the manufacturing efficiency and the guarantee for the product performance.

In another embodiment, the LED luminous bodies are high-voltage, which is beneficial to the manufacture of a high-voltage parallel connection product.

For the embodiment as shown in FIG. 1, the buckles 102, the light guide surface 101 and the holes 103 penetrated by the strip-shaped conducting wire 104 may be molded once in the injection molding process of the injection molding body.

Figure 2:
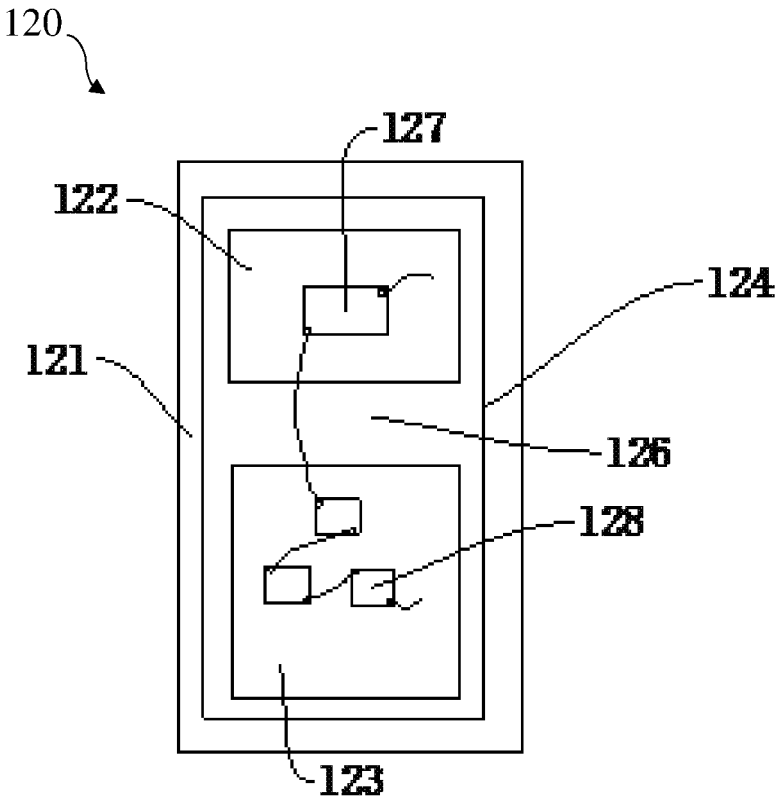
FIG. 2 is a schematic structural view of an LED luminous body at a first viewing angle in an embodiment of the present invention.

In another embodiment, with reference to FIG. 2, each of the LED luminous bodies 120 is internally provided with LED chips 128, and the LED luminous body 120 emits light via the LED chips 128. The LED chips 128 are high-voltage chips, a strip-shaped high-voltage lamp may also be formed even if all the LED luminous bodies 120 are connected in parallel with one another; and during use, a power supply demand can also be met without converting commercial power into a low voltage lower than a safety voltage by means of a transformer, and then, the problem that the energy consumption is increased due to low conversion efficiency in a conversion process is avoided. It needs to be noted that the high-voltage chips are structures in the prior art.

Further, there may be a plurality of LED chips 128, the plurality of LED chips 128 are connected in series with one another so that a required voltage of single LED luminous body 120 meets a demand Exemplarily, there are three LED chips 128, and the three LED chips 128 are connected in series with one another, in this way, the voltage is the sum of voltages of the three LED chips 128. It can be understood that the number of the LED chips 128 may also be set according to the required voltage of the LED luminous body 120 in other embodiments, for example, the number of the LED chips 128 is set as one, two or four and the like.

Further, each of the LED luminous bodies 120 further includes a current-limiting IC 127 connected in series with the LED chips 128. By disposing the current-limiting IC 127, it is ensured that currents output by all the LED luminous bodies 120 are kept consistent. Meanwhile, when the head and tail of a module 100 of the LED lamp are within a working voltage range of the current-limiting IC 127, it can be ensured that the brightness of the LED luminous bodies 120 at the head and tail of the module 100 of the LED lamp is kept consistent. More preferably, the current-limiting IC is a constant-current chip.

Specifically, each of the LED luminous bodies 120 includes a support frame 121 as well as a first substrate 122 and a second substrate 123 which are disposed on the support frame 121, the current-limiting IC 127 is disposed on the first substrate 122, and all of the LED chips 128 are disposed on the second substrate 123.

Figure 3:
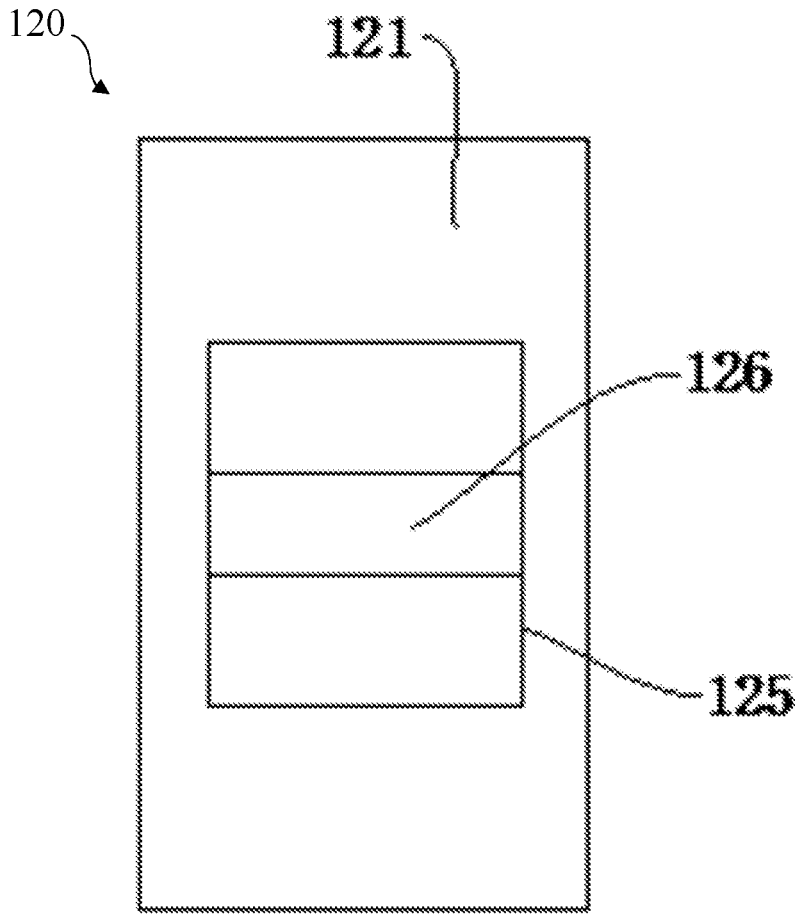
FIG. 3 is a schematic structural view of an LED luminous body at a second viewing angle in an embodiment of the present invention.

FIG. 3 is a schematic structural view of an LED luminous body 120 in an LED lamp manufactured by an injection molding process at a second viewing angle in an embodiment of the present invention, specifically, FIG. 2 shows an obverse structure of the LED luminous body 120, and FIG. 3 shows a reverse structure of the LED luminous body 120.

With reference to FIG. 2 and FIG. 3, it can be understood that the LED luminous body 120 is a luminous body emitting light on both sides, and thus, the luminous body is wider in light emitting range and better in use effect.

Specifically, the support frame 121 of the LED luminous body 120 is provided with a first cup 124 and a second cup 125 which are disposed back to back, a light transmitting layer 126 is disposed between the first cup 124 and the second cup 125, and thus, rays emitted from the inside of the first cup 124 may be emitted from the second cup 125 after penetrating through the light transmitting layer 126, or rays emitted from the inside of the second cup 125 may be emitted from the first cup 124 after penetrating through the light transmitting layer 126.

Optionally, a portion of the first substrate 122 and a portion of the second substrate 123 respectively form parts of the bottom wall of the first cup 124, the LED chips 128 are disposed in the first cup 124 and are welded and fixed to the second substrate 123, and meanwhile, the current-limiting IC 127 is disposed in the first cup 124 and is welded and fixed to the first substrate 122. The light transmitting layer 126 is disposed between the first substrate 122 and the second substrate 123, that is, rays emitted by the LED chips 128 in the first cup 124 enter the second cup 125 after penetrating through the light transmitting layer 126 and are emitted outwards, and thus, a double-sided light emitting effect is achieved. Specifically, the light transmitting layer 126 is made of a transparent material.

The second cup 125 is internally provided with a diffusion layer made of a diffusion material, rays entering from the first cup 124 to the second cup 125 are diffused via the diffusion material in the diffusion layer when being emitted outwards, then, there is no great difference between the light emitting effect of the LED luminous body 120 emitting light from the reverse side and the light emitting effect of the LED luminous body 120 emitting light from the obverse side, and thus, the lighting effect of the LED luminous body 120 is improved.

In an embodiment, the strip-shaped conducting wire 104 adopts an outdoor rubber wire by which the aging problem occurring in a use process can be effectively avoided, and the service life can be prolonged. Of course, the strip-shaped conducting wire 104 is not limited thereto and may be other flexible wires such as a PVC wire.

Figure 4:
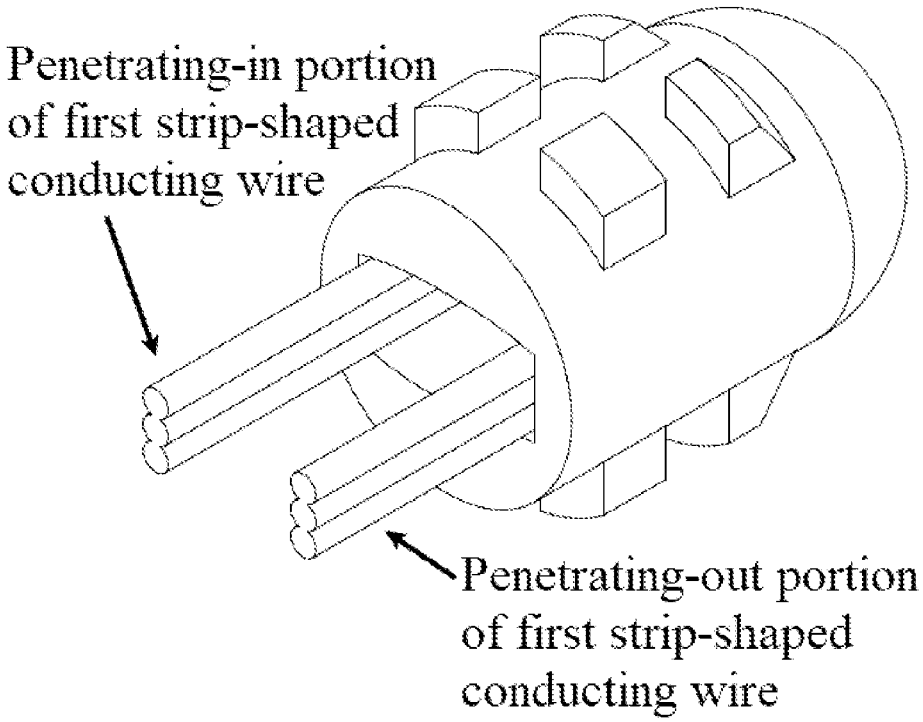
FIG. 4 is a schematic structural view of an LED lamp manufactured by an injection molding process in an embodiment of the present invention.

In another embodiment, with reference to FIG. 4, when the first strip-shaped conducting wire penetrates into or out of the injection molding body via a hole in the injection molding body, a penetrating-in portion of the first strip-shaped conducting wire is approximately parallel to a penetrating-out portion of the first strip-shaped conducting wire.

Found by comparison with FIG. 1, in FIG. 1, for the first strip-shaped conducting wire 104, the penetrating-in portion and the penetrating-out portion of the first strip-shaped conducting wire 104 approximately extend in the same direction. Meanwhile, it can be understood that, for the holes 103 in FIG. 1 and the holes in FIG. 4, although their positions and manners of how the first strip-shaped conducting wire 104 passes through are different, such differences are merely differences of exemplary embodiments. For example, two approximately orthogonal holes are disposed, and thus, the penetrating-in portion and the penetrating-out portion of the first strip-shaped conducting wire 104 are approximately perpendicular in different directions, which is exampled as follows:

(1) the two approximately orthogonal holes 103 may refer to FIG. 1, wherein the two holes are still located on positions close to the light guide surface 101 and are coplanar, however, the two holes 103 in FIG. 1 are equivalent to a through hole, with two openings being 180 DEG; if the two holes are orthogonal, it is equivalent that two openings of the two holes 103 are 90 DEG;

it can be understood that such two orthogonal holes 103 may be located in remaining positions away from the light guide surface 101 in addition to a similar position close to the light guide surface 101 in FIG. 1, that is, the two holes 103 may be located in any two approximately orthogonal positions on sides of a cylindrical body of the injection molding body; and (2) the two approximately orthogonal holes may further refer to FIG. 1 and FIG. 4, wherein one of the holes is similar to the hole 103 in one side in FIG. 1, and the other hole is similar to the hole in FIG. 4, that is, one of the holes is located in any one position on the side of the cylindrical body of the injection molding body, and the other hole is located in the cylindrical body of the injection molding body.

For the skilled in the art, no matter the penetrating-in portion and the penetrating-out portion of the first strip-shaped conducting wire 104 approximately extend in the same direction, or are approximately parallel, or are in other positional relationships except those, different designs for the holes 103 and the manner of how the first strip-shaped conducting wire 104 passes through may be performed.

It needs to be noted that, for the light guide surface 101 in FIG. 1 and FIG. 4, the LED luminous bodies are located in corresponding areas inside the light guide surface 101. The buckles 102, the light guide surface 101 and the holes 103 penetrated by the strip-shaped conducting wire may be molded once in the injection molding process of the injection molding body.

Since a pore is reserved for the hole 103 in FIG. 1, the strip-shaped conducting wire with the LED luminous bodies may penetrate into the hole 103 in FIG. 1 via the pore and be located in the corresponding area inside the light guide surface 101 in an appropriate manner such as a manner of adopting an internal structure for fixing the LED luminous bodies or a gluing manner. During gluing, the strip-shaped conducting wire and the LED luminous bodies thereon penetrate in the hole 103 reserved with the pore and are then fixed by filling glue in the hole 103. Apparently, the position where the hole 103 is located is only glued, which is much simpler than a process for filling a great deal of glue in the prior art.

For the hole in FIG. 4, similarly, since a pore is reserved for the hole, the penetrating-in portion of the strip-shaped conducting wire and the penetrating-out portion of the strip-shaped conducting wire penetrate in or out of the hole, and a gap is remained between the two portions. Therefore, the strip-shaped conducting wire with the LED luminous bodies may penetrate into the hole in FIG. 4 due to the arrangement of the pore and may be located on the corresponding area inside the light guide surface 101 in an appropriate manner such as a manner of adopting an internal structure for fixing the LED luminous bodies or a gluing manner. During gluing, the strip-shaped conducting wire and the LED luminous bodies thereon penetrate in or out of the hole, reserved with the pore, in a bending manner and are then fixed by filling glue in the hole.

In addition to this, under the condition that the pressure for injection molding is controlled, it is also selectable that the injection molding body, the strip-shaped conducting wire, and the LED luminous bodies on the strip-shaped conducting wire are formed by performing injection molding once, and the pressure damage for the LED luminous bodies is prevented.

The process can also be as follows: firstly, using a small size (for example, less than 2 cm*1 cm) PCB (printed circuit board) to weld LED chip(s) to form an LED unit; secondly, welding two segments of wires at both ends of the LED unit, and finally inserting the LED unit into the injection molding. In this way, the LED unit can be fixed by means of plugs or glue filling. Thus, a plurality of LED units connected with each other with the injection moldings can be used to form an LED lamp string. It should be understood that, we can use semi-finished lamps or lamp strings to make finished products. It should be noted that the shape of the PCB can be square or round, and the shape of the injection molding can also be flexibly selected.

The above descriptions are merely specific embodiments of the present invention, but the protection scope of the present invention is not limited thereto. Any variations or replacements that may be readily envisioned by those skilled in the art within the technical scope disclosed by the present invention should fall within the protection scope of the present invention. Therefore, the protection scope of the present invention should be subject to the protection scope defined in the claims.

The invention claimed is:

1. An LED lamp manufactured by an injection molding process, comprising a strip-shaped LED lamp, wherein the strip-shaped LED lamp comprises a first strip-shaped conducting wire, a first hole, a second hole, and a least one LED luminous body disposed on the strip-shaped conducting wire, and each of the at least one LED luminous body comprises a first chip and a second chip connected to the first chip via a second conducting wire, a third chip, and a support frame, wherein each of the first chip and the second chip comprise a first substrate and a second substrate each disposed on the support frame, a light transmitting layer disposed between the first substrate and the second substrate, a current-limiting integrated circuit (IC) disposed on the first substrate, and LED chips disposed on the second substrate; and an injection molding body, wherein:

the first strip-shaped conducting wire penetrates into the injection molding body via the first hole and out of the injection molding body via the second hole, wherein the first hole is positioned on a first surface of the injection molding body adjacent to a light guide surface of the at least one LED luminous body and the second hole is positioned on a second surface of the injection molding body such that an opening of the first hole is orthogonal to an opening of the second hole;

a penetrating-in portion of the first strip-shaped conducting wire is perpendicular to a penetrating-out portion of the first strip-shaped conducting wire;

the first chip in each of the LED luminous bodies is an LED chip, and the second chip is used for controlling the power supply for the LED chip; the third chip is used for processing a data signal of the LED chips and the second chip includes a constant-current chip;

the LED chips of the first chip are configured to emit rays that enter the second chip after penetrating through the light transmitting layer and emitted outwards such that a double-sided light emitting effect is achieved;

the first strip-shaped conducting wire comprises two or at least three conducting wires which are insulated from one another;

printed circuit boards and resistors are omitted in the LED luminous bodies;

the injection molding body comprises buckles, wherein the buckles comprise a first buckle, a second buckle, a third buckle, and a fourth buckle, a first buckle gap is disposed between the first buckle and the second buckle, a second buckle gap is disposed between the third buckle and the fourth buckle, and the LED lamp manufactured by the injection molding process passes through the first buckle gap and/or the second buckle gap;

the first buckle, the second buckle, the third buckle, and the fourth buckle are disposed on a first side of the injection molding body; and the first buckle and the third buckle are located on a first height position of the injection molding body, the second buckle and the fourth buckle are located on a second height position of the injection molding body, and the first buckle gap is equal to the second buckle gap.

2. The LED lamp manufactured by the injection molding process of claim 1, wherein preferably, the second conducting wire comprises any one of the following wires: a gold wire, a silver wire, and an alloy wire.

3. The LED lamp manufactured by the injection molding process of claim 1, wherein when penetrating into the injection molding body, the first strip-shaped conducting wire penetrates into and out of the injection molding body via a hole in the injection molding body, and a penetrating-in portion of the first strip-shaped conducting wire and a penetrating-out portion of the first strip-shaped conducting wire approximately extend in the same direction; or the penetrating-in portion of the first strip-shaped conducting wire and the penetrating-out portion of the first strip-shaped conducting wire are approximately parallel.

4. The LED lamp manufactured by the injection molding process of claim 1, wherein the LED lamp manufactured by the injection molding process comprises a plurality of LED luminous bodies which are connected in parallel or in series.

* * * * *